US005094591A

United States Patent [19]

Whitley, II et al.

[11] Patent Number: 5,094,591

[45] Date of Patent: Mar. 10, 1992

[54] PORTABLE PUMP

[75] Inventors: Warwick M. Whitley, II, Lynn Haven, Fla.; Edward G. Malone, Grand Rapids, Mich.

[73] Assignee: Attwood Corporation, Lowell, Mich.

[21] Appl. No.: 633,106

[22] Filed: Dec. 24, 1990

[51] Int. Cl.[5] ..... F04B 17/00; F04B 35/04

[52] U.S. Cl. ..... 417/234; 417/423.3; 417/423.9

[58] Field of Search ..... 417/234, 411, 423.14, 417/423.3, 423.9

[56] References Cited

U.S. PATENT DOCUMENTS

| | | | |
|---|---|---|---|
| D. 191,687 | 10/1961 | Wessels | D65/1 |
| D. 194,722 | 2/1963 | Umholtz | D65/1 |
| D. 195,535 | 6/1963 | Rhoades et al. | D65/1 |
| D. 220,552 | 4/1971 | Davis | D65/1 |
| D. 236,756 | 9/1975 | Franzen et al. | D65/1 |
| D. 237,011 | 9/1975 | Stroberg et al. | D65/1 |
| D. 242,651 | 12/1976 | Arakawa | D15/7 |
| D. 252,149 | 6/1979 | Pages | D15/7 |
| D. 258,210 | 2/1981 | Shure | D15/7 |
| D. 268,412 | 3/1983 | Davis | D15/7 |
| D. 286,782 | 11/1986 | Somers | D15/7 |
| D. 289,402 | 4/1987 | Carlson et al. | D15/7 |
| D. 295,522 | 5/1988 | Martin et al. | D15/7 |
| D. 299,720 | 2/1989 | Yoo | D15/7 |
| D. 301,887 | 6/1989 | Price et al. | D15/7 |
| D. 306,447 | 3/1990 | Whitley, II | D15/7 |
| D. 306,596 | 3/1990 | Maddock | D15/7 |
| 1,049,729 | 1/1913 | Kaiser | 730/117 |
| 1,647,818 | 11/1927 | Semak | 417/234 |
| 2,221,635 | 11/1940 | Gettwart et al. | 103/152 |
| 2,339,287 | 1/1944 | Neef, Jr. | 221/80 |
| 3,015,281 | 1/1962 | Umholtz | 103/118 |
| 3,316,845 | 5/1967 | Schumann | 103/26 |
| 3,318,249 | 9/1967 | Loeser | 103/25 |
| 3,407,739 | 10/1968 | Myers | 417/423.14 |
| 3,556,677 | 1/1971 | Tremain | 417/414 |
| 3,576,379 | 4/1971 | Parise | 417/410 |
| 3,685,926 | 8/1972 | Blum | 417/424 |
| 3,719,429 | 3/1973 | Rule | 417/201 |
| 3,720,489 | 3/1973 | Raper | 418/45 |
| 3,748,066 | 7/1973 | Sully et al. | 417/424 |
| 3,776,666 | 12/1973 | Ludwig | 417/411 |
| 3,802,806 | 4/1974 | Blum | 417/424 |
| 3,861,831 | 1/1975 | Rule | 417/424 |
| 3,885,892 | 5/1975 | Dwyer et al. | 417/234 |
| 3,910,725 | 10/1975 | Rule | 417/234 |
| 3,915,351 | 10/1975 | Kiralfy | 222/385 |
| 3,941,073 | 3/1976 | Ridgeway | 114/183 |
| 4,021,150 | 5/1977 | Mabuchi | 417/411 |
| 4,050,396 | 9/1977 | Ridgeway | 114/183 |
| 4,053,262 | 10/1977 | Horvath | 417/424 |
| 4,060,182 | 11/1977 | Kikuchi | 222/333 |
| 4,218,195 | 8/1980 | Shure | 417/411 |
| 4,275,995 | 6/1981 | Taylor | 417/40 |
| 4,466,780 | 8/1984 | Naurath | 417/423.14 |
| 4,621,984 | 11/1986 | Fussell | 417/234 |
| 4,789,307 | 12/1988 | Sloan | 417/40 |
| 4,806,083 | 2/1989 | LeGrange et al. | 417/423.14 |
| 4,810,169 | 3/1989 | Kranzle | 417/63 |

*Primary Examiner*—Richard A. Bertsch
*Assistant Examiner*—Peter Korytnyk
*Attorney, Agent, or Firm*—Price, Heneveld, Cooper, Dewitt & Litton

[57] ABSTRACT

A portable pump assembly having a hollow housing with enlarged top and bottom is provided for holding a motor, switch, and battery pack. A pump chamber is formed on the underside of the housing and houses a pump impeller mounted on the end of the motor shaft. A flexible discharge tube extends from the pump and passes through an opening in the enlarged bottom such that the tube may be conveniently wrapped around the housing for storage or extended for use. A removable cover provides an easy access for replacing batteries. Further, the batteries are carried in a battery pack which plugs into a receptacle in the housing, thus simplifying and speeding battery replacement.

19 Claims, 3 Drawing Sheets

PORTABLE PUMP

BACKGROUND OF THE INVENTION

This invention relates to a liquid pump, and more particularly to a portable battery operated pump for marine use and for pumping out spas and hot tubs.

In many applications, particularly boating and for pumping out spas and hot tubs, there is a need for a self-contained portable pump which is easily used and stored and which does not require a 110 VAC power source. Further, improvements in portability are desirable such as by reducing weight and improving the ease of carrying. Also, means which simplify the replacement of batteries are also desirable.

SUMMARY OF THE INVENTION

A portable pump embodying the present invention is provided which comprises a hollow housing including a water impervious chamber having interior surfaces shaped for holding a motor, a switch and batteries. Positioned within the chamber, the motor is operably connected to a means for pumping fluid and electrically connected to the switch and batteries. A flexible discharge tube is connected to the means for pumping, the discharge tube having both an extended use position and a wound storage position. The housing has a tube retaining surface between an enlarged top and bottom. The surface is adapted to receive the discharge tube when the tube is wound about the surface for storage.

Another aspect of the invention includes an opening in the enlarged bottom which orients the discharge tube upwardly from the means for pumping and adjacent the tube retaining surface of the housing.

Another aspect of the invention includes a removable cover which facilitates battery replacement and includes a handle for carrying the pump.

Another aspect of the invention includes a replaceable battery pack which can be plugged into a receptacle in the housing thus facilitating battery replacement.

Another aspect of the invention includes a pump chamber, a portion of which is integrally molded into the bottom of the housing.

In accordance with this invention, a unique and exceptionally functional portable pump for marine use, for pumping out spas and hot tubs, and for other like uses is provided.

BRIEF DESCRIPTION OF THE DRAWINGS

This invention and its function and operation will be further explained by the following description with reference to the drawings in which.

BRIEF DESCRIPTION OF THE PREFERRED EMBODIMENT

Figure 1:
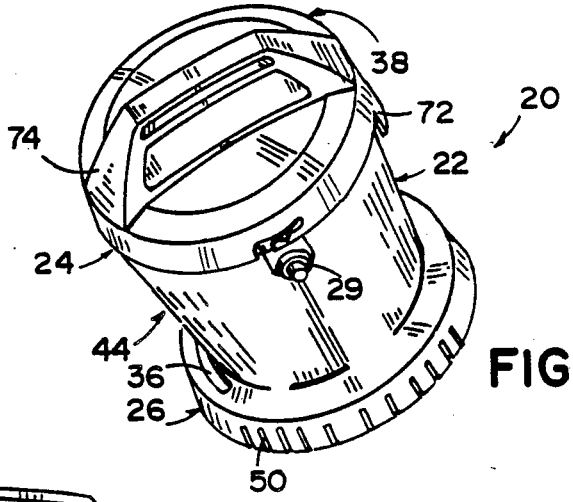
FIG. 1 is a perspective view of a pump assembly embodying the present invention and shown without the discharge tube.
Figure 2:
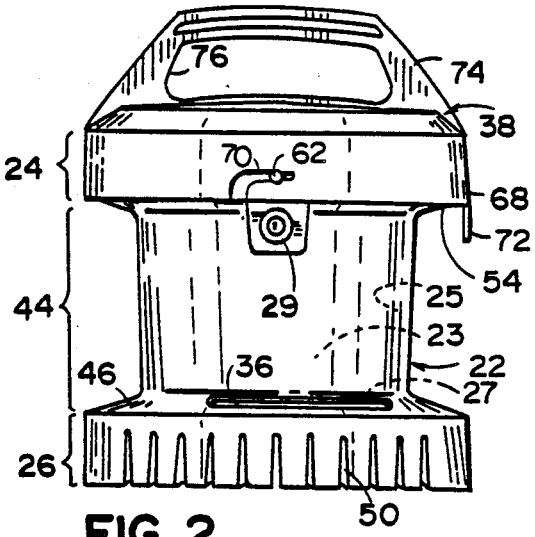
FIG. 2 is a side elevational view of one side of the pump of FIG. 1.
Figure 3:
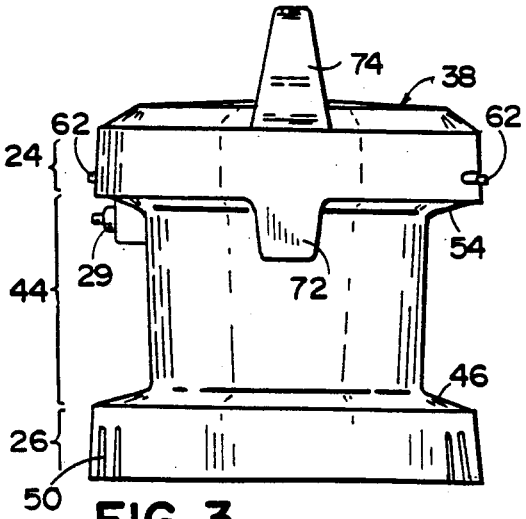
FIG. 3 is a front elevational view of the pump of FIG. 1 with the discharge tube removed.

The reference numeral 20 (FIG. 1–5) generally designates a portable pump assembly embodying the present invention. Portable pump 20 includes a hollow housing 22 which has an enlarged top 24 and an enlarged bottom 26. Housing 22 defines a chamber 23 with sides 25 and floor 27 which is designed to hold a motor 28, a switch assembly 29 and a battery pack 32. A pump 30 attaches to the underside of floor 27 and operably connects to motor 28. A flexible discharge tube 34 extends from pump 30 and passes upwardly through an elongated opening 36 in enlarged bottom 26 such that tube 34 may be conveniently wrapped around housing 22 for storage or unwrapped and extended for use. A removable cover 38 provides a convenient access for removing battery pack 32 for replacing batteries 40. Battery pack 32 plugs into a receptacle 42 in housing 22, thus simplifying and speeding battery replacement The exterior of housing 22 (FIGS. 1–3 and 6) includes a substantially cylindrical middle portion 44 which is bounded at the top by enlarged top 24 and enlarged bottom 26. Enlarged bottom 26 includes an outwardly extending wall section 46 which includes material forming an elongated opening 36 through which flexible discharge tube 34 passes, thus positioning tube 34 adjacent the exterior surface of middle portion 44. Fins 50 drapingly extend downwardly from outwardly extending wall 46. Fins 50 are spaced one from the other providing openings 51 through which water can pass to the pump chamber 52 as will be described. Fins 50 support portable pump 20 in its normally upright position, and also provide a rough screen to prevent large objects from entering pump chamber 52

Enlarged top 24 of housing 22 (FIG. 6) includes an outwardly extending wall 54 similar to wall 46. Upright wall 56 extends upwardly from outwardly extending wall 54 and includes a means for sealing. The preferred embodiment includes a depression 58 which receives 'O' ring 60 and seals against removable cover 38. Upper upright wall 56 also includes means for retaining removable cover 38 such as the illustrated bayonet 62 which engages slot 70 within removable cover 38. Located adjacent and below upright wall 56 is switch stanchion 64 which receives and supports switch assembly 29 in the switch opening 57. A cover 59 or other sealing means is provided to cover switch housing 66 and to prevent water from passing through opening 57. Cover 59 includes a lip 61 which is sealingly compressed under switch retention nut 63 against housing 22.

Figure 4:
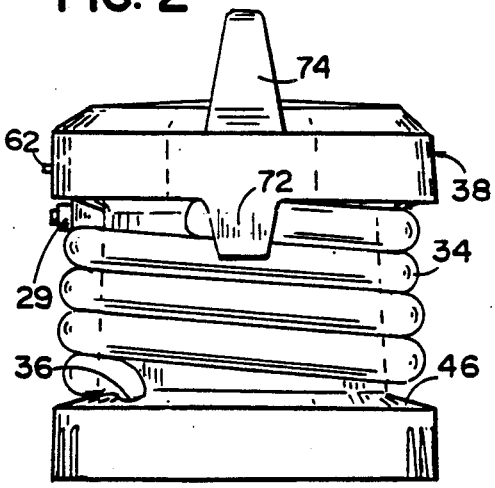
FIG. 4 is a front elevational view of the pump with the discharge tube in storage position.
Figure 5:
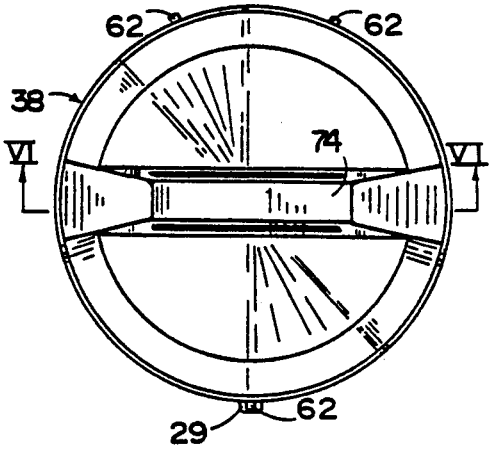
FIG. 5 is a top plan view of the pump.

Removable cover 38 (FIGS. 1–6) is shaped to sealingly engage upright wall 56 of enlarged top 24. Cover 38 includes a downwardly extending wall section 68 which slips downwardly over upright wall 56 and engages 'O' ring 60 to sealingly cover housing 22 and provide a substantial water tight interior compartment or chamber 23 within housing 22. Downwardly extending wall 68 includes slots 70 which cooperate with bayonets 62 of enlarged top 24 to matably hold removable cover 38 onto housing 22. Downwardly extending tab 72 extends down from wall 68 a sufficient distance to cooperatingly hold discharge tube 34 between tab 72 and middle portion 44 as best shown in FIG. 4. A handle 74 extends from one side of removable cover 38 to the other side and includes a finger grip opening 76 for gripping handle 74. On the under side of removable cover 38 is a downwardly extending protrusion 78 which assists in holding battery pack 32 in place within housing 22.

Figure 13:
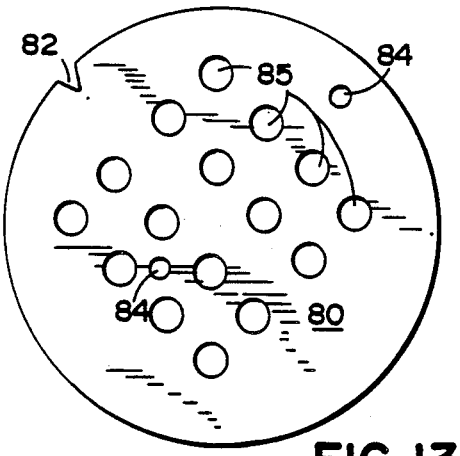
FIG. 13 is a plan view of the ballast plate of the pump.
Figure 10:
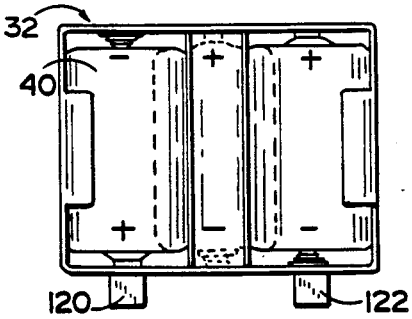
FIG. 10 is a side view of the battery pack.
Figure 9:
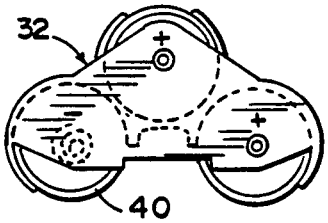
FIG. 9 is a top view of the battery pack casing with batteries shown included.
Figure 8:
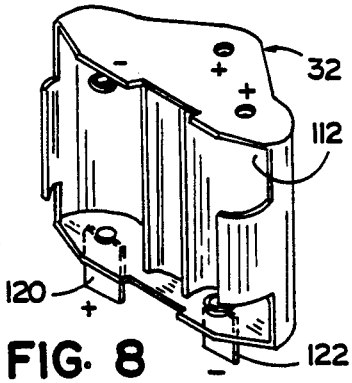
FIG. 8 is a perspective view of the battery pack casing.
Figure 6:
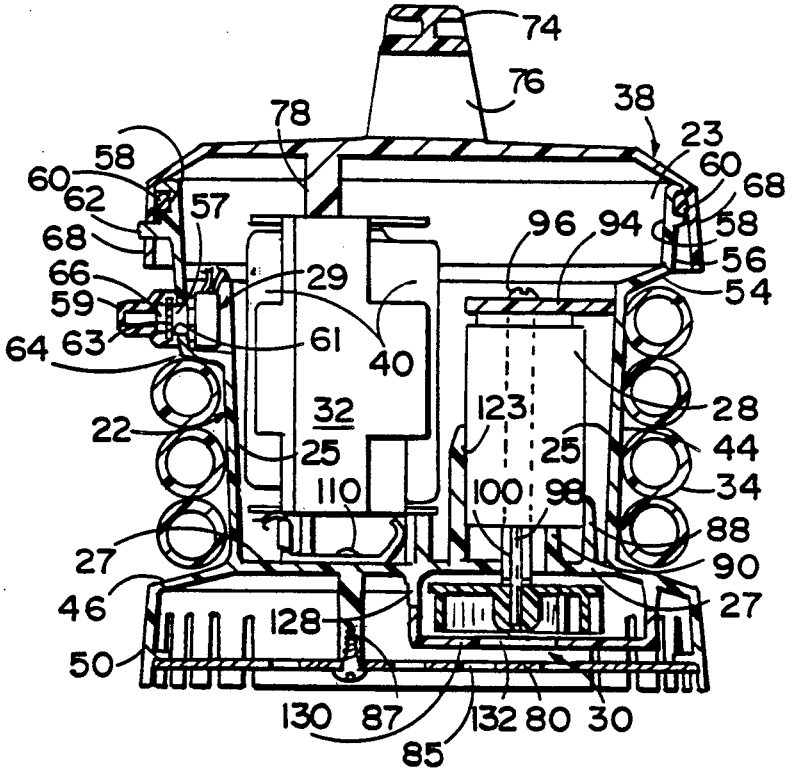
FIG. 6 is a cross-sectional view taken through lines VI—VI in FIG. 5.

Attached to the bottom of pump housing 22 within fins 50 is ballast plate 80 (FIGS. 6 and 13). Plate 80 provides a ballast to keep pump 20 in a normally upright position when pump 20 is placed in water. Ballast plate 20 is substantially a disc shaped plate cut from metal and is sufficient in weight to perform its intended function. Ballast plate 80 includes a notch 82 which rotationally orients ballast plate 80 such that attachment holes 84 are properly located above hollow bosses 87 to facilitate attachment. Ballast plate 80 also contains water inlet holes 85.

The chamber 23 of housing 22 (FIGS. 6–7) is defined by various configurated surfaces to retain motor 28 and battery pack 32. In the preferred embodiment, motor retaining ribs 88 extend circularly around motor 28 to position motor 28 laterally, while motor positioning ribs 90 position motor 28 vertically so that it may be properly attached to pump 30. Two retention bosses 92 are positioned on either side of motor 28 such that motor retention bracket 94 and elongated retention screws 96 may be assembled over motor 28 to hold motor 28 in place. As positioned in assembly, motor 28 includes an elongated shaft 98 which extends downwardly through a shaft opening 100 in floor 27 into pump chamber 52. Pump impeller 134 attaches to the end of shaft 98 inside of pump chamber 52 described below.

Figure 7:
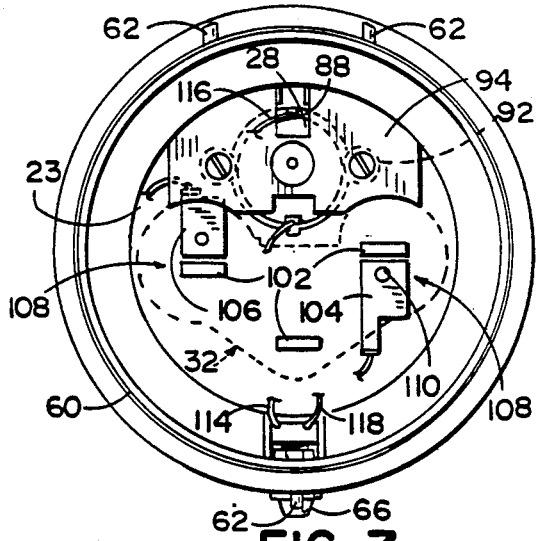
FIG. 7 is a top plan view of the pump with the cover and battery pack of the pump removed.
Figure 11:
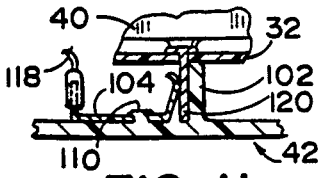
FIG. 11 is an enlarged partial view of the lower end of the battery pack as installed and illustrating the electrical connections.

Floor 27 of housing 22 also includes three upstanding positioning ribs 102 (FIGS. 6, 7 and 11). Two of the positioning ribs 102 cooperate with contacts 104 and 106 to form a receptacle 42 for battery pack 32 as best illustrated in FIG. 11.

Battery pack 32 (FIGS. 7–11) holds one or more batteries 40 in a manner such that batteries 40 are easily removable from battery pack 32 as is commonly known in the art. Battery pack 32 includes surfaces 112 suitable for holding individual batteries 40, and jumpers (not shown) such that batteries 40 are connected electrically in series to downwardly extending metal tabs 120 and 122. Downwardly extending tabs 120 and 122 plug into receptacle 108 completing an electrical circuit with motor 28 and switch 66. Battery pack 32 is designed to matably fit within housing 22 and adjacent motor 28 and is guided to its proper position by ribs 123 adjacent to the batteries and attached to motor retention bracket 94.

Motor 28 is electrically connected to batteries 40 and switch 29 to complete an electrical circuit. Specifically, motor 26 is electrically connected through wire 114 to one side of switch 29, and electrically connected through wire 116, battery pack 32 and wire 118 to the other side of switch 29.

Figure 12:
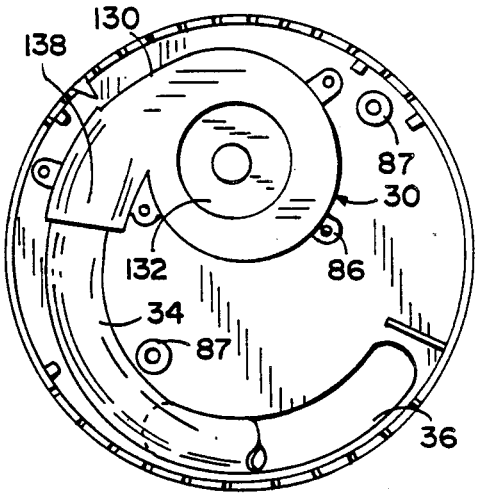
FIG. 12 is a bottom view of the pump housing with the ballast plate removed.
Figure 14:
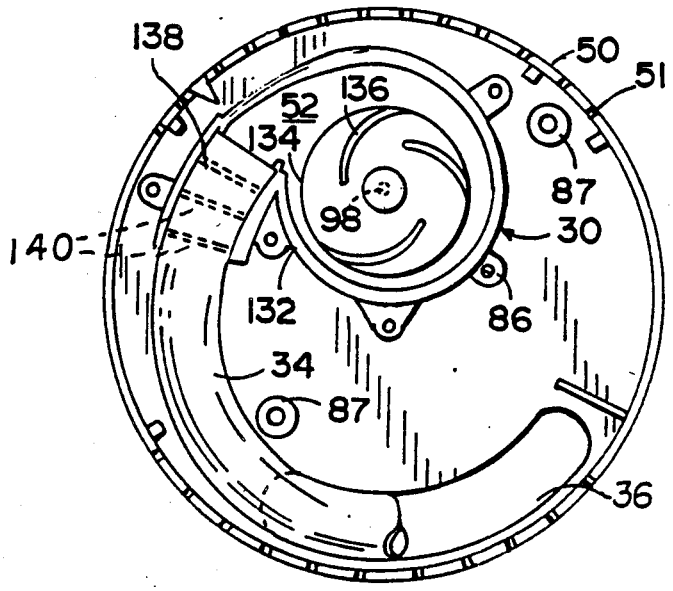
FIG. 14 is a bottom view of the pump housing with the ballast plate and lower cover of the pump chamber removed.

Pump 30 (FIGS. 6, 12 and 14) includes a pumping chamber 52 which is formed by an upper side wall 128 molded integrally with floor 27 of housing 22, and a separately molded lower side wall 130. Lower side wall 130 includes a water entrance opening or inlet 132, ballast attachment boss 87, and multiple attaching tabs 86. Side walls 128 and 130 join to enclose pump impeller 134 and form a ridged annular opening or outlet 138 with ridges 140 for accepting and retaining an end of discharge tube 34. Pumping chamber 52 is a spirally shaped chamber which cooperates with impeller fins 136 of impeller 134 to pressure water through pump outlet 138.

Water enters through inlet 132 in pump 30 and is forced outwardly by impeller fins 136 through discharge outlet 138 and into discharge tube 34. As shown, discharge tube 34 is connected to discharge outlet 138 of pump 30, discharge tube 34 extending circumferentially and upwardly through elongated opening 36 in housing 22. Flexible discharge tube 34 is sufficiently long to perform its intended function and as noted, tube 34 may take on an extended use position or be wrapped around housing 22 in a wrapped storage position. In the storage position, flexible discharge tube 34 is wrapped around middle portion 44 between enlarged top 24 and enlarged bottom 26 of housing 22 with the terminal end of flexible discharge tube 34 tucked under downwardly extending tab 72 (FIG. 4).

OPERATION

Having described the components of the preferred embodiment, the use and advantages of the present invention should become obvious to one skilled in the art. Briefly, portable pump 20 is assembled with motor 28 secured within housing 22 by motor retention bracket 94 and pump 30 properly mounted on the end of downwardly extending motor shaft 98. Flexible tube 34 is assembled to pump 30 and routed through elongated opening 48 such that discharge tube 34 may be wound around middle portion 44 of housing 22 in a storage position. Ballast plate 80 is assembled to the bottom of housing 22 within fins 50 to form a rough screen to prevent large debris from entering pump chamber 52 of pump 30.

When an operator desires to use pump assembly 20, the operator places batteries 40 into battery pack 32 and, in turn, places battery pack 32 into housing 22 such that tabs 120 and 122 engage contacts 104 and 106 within housing 22. Thus, an electrical circuit is completed with motor 28 and switch 29. Cover 38 is then sealingly replaced onto housing 22 and twisted to engage bayonets 22 within slots 70, thus holding cover 38 securely and sealingly in place on housing 22.

The pump is then placed in the water to be pumped with fins 50 extending downwardly into the volume of water and discharge tube 34 extended and positioned as desired. Water tight switch 29 is switched on such that motor 28 activates pump 30 to pump water through discharge tube 34, water flowing through discharge tube 34 outward to the desired discharge point.

When the water has been properly moved and the pump is no longer needed, the operator winds discharge tube 34 around the middle portion 44 of housing 22 between enlarged top 24 and enlarged bottom 26. The terminal end of discharge tube 34 is then tucked underneath downwardly extending tab 72 such that discharge tube 34 is conveniently held in position around housing 22 without further inconvenience to the operator.

In the foregoing description, it will be readily appreciated by those skilled in the art that modifications may be made to the invention without departing from the concepts disclosed herein. Such modifications are to be considered as included in the following claims, unless these claims by there language expressly state otherwise.

The embodiments of the invention in which an exclusive property or privilege is claimed are defined as follows.

1. A portable pump assembly comprising:

a housing defining a hollow chamber having interior surfaces suitably shaped for holding a motor and batteries, said housing further including an exterior middle surface bounded by an enlarged top and bottom;

a motor positioned on said interior surfaces;

batteries positioned on said interior surfaces;

means for pumping fluid operably connected to said motor;

a switch located on said housing;

means for electrically connecting said motor to said batteries and said switch to complete and electrical circuit;

a flexible discharge tube operably connected to said means for pumping having an extended use position and a wound storage position, said tube being wound about said exterior middle surface in a position surrounding said motor and batteries when in said wound storage position; and means for holding said discharge tube in said storage position about said housing between said enlarged top and bottom.

2. The pump assembly defined in claim 1 wherein said housing has an upwardly facing opening for accessing said motor and batteries; and a removable cover is operably shaped to sealingly and detachably cover said opening in said housing.

3. The pump assembly defined in claim 2 wherein said means for holding said discharge tube in said wound storage position includes at least one downwardly extending tab spaced from said exterior middle surface and located on said removable cover.

4. The pump assembly defined in claim 2 wherein said removable cover and said cover include a means of attachment which does not utilize fasteners.

5. The pump assembly defined in claim 2 wherein said removable cover includes an upstanding handle.

6. The pump assembly defined in claim 1 wherein said discharge tube is oriented tangentially to said housing where said tube connects to said means for pumping to facilitate wrapping said tube around said housing.

7. The pump assembly defined in claim 1 wherein said enlarged bottom includes an opening and said discharge tube passes upwardly through said opening positioning said tube to wrap around said housing.

8. The pump assembly defined in claim 1 including a removable battery pack for holding and electrically interconnecting said batteries.

9. The pump assembly defined in claim 8 wherein said housing includes an electrical receptacle and said battery pack plugs into said receptacle.

10. The pump assembly defined in claim 1 wherein said enlarged bottom includes downwardly extending fins to filter large debris from said means for pumping.

11. The pump assembly defined in claim 1 wherein said enlarged bottom includes a means for keeping said pump upright.

12. The pump assembly defined in claim 11 wherein said means for keeping said pump upright includes a flat ballast fastened to said enlarged bottom of said housing, said ballast cooperating with said housing to form a rough screen for large debris.

13. The pump assembly defined in claim 1 wherein said housing includes a hole for said switch and said switch includes a protruding portion and an interior portion, said switch further includes a resilient covering which sealingly covers said protruding portion of said switch and said hole for said switch.

14. The pump assembly defined in claim 1 wherein said housing includes an electrical receptacle, and said means for electrically connecting includes a battery pack which further includes means for plugging into said electrical receptacle in said housing.

15. The pump assembly defined in claim 14 wherein said means for plugging into said receptacle includes downwardly extending electrical contacts.

16. The pump assembly defined in claim 1 wherein said means for pumping includes an upper sidewall integrally molded to said bottom of said housing and a separate lower sidewall which mates with said upper side all to form a pumping chamber having an inlet and outlet, said means for pumping further including a pump impeller mounted to said motor cooperating with said upper and lower sidewalls to draw water into said inlet and bias water outwardly through said outlet.

17. The pump assembly defined in claim 16 wherein said upper and lower sidewalls form a ridged annular opening defining said pump outlet for retaining said discharge tube in said pump outlet.

18. The pump assembly defined in claim 17 including a flat ballast, said ballast fastening to said housing to protect said pumping chamber from damage.

19. The pump assembly defined in claim 1 wherein said means for holding includes a tab spaced from said exterior middle surface that cooperatingly holds said discharge tube against said exterior middle surface when in said wound storage position.

* * * * *

UNITED STATES PATENT AND TRADEMARK OFFICE

CERTIFICATE OF CORRECTION

PATENT NO. : 5,094,591

DATED : March 10, 1992

INVENTOR(S) : Warwick M. Whitley, II et al.

It is certified that error appears in the above-identified patent and that said Letters Patent is hereby corrected as shown below:

Column 6, claim 16, line 38:
"all" should be --wall--.

Signed and Sealed this

Fifth Day of October, 1993

Bruce Lehman

*Attest:*

BRUCE LEHMAN

*Attesting Officer*

*Commissioner of Patents and Trademarks*